United States Patent [19]

Pappal et al.

[11] Patent Number: 5,006,495

[45] **Date of Patent: * Apr. 9, 1991**

[54] FLUID CATALYTIC CRACKING REGENERATION

[75] Inventors: David A. Pappal; Michael S. Sarli, both of Haddonfield, N.J.

[73] Assignee: Mobil Oil Corporation, Fairfax, Va.

[ * ] Notice: The portion of the term of this patent subsequent to Jun. 27, 2006 has been disclaimed.

[21] Appl. No.: 488,471

[22] Filed: Feb. 26, 1990

Related U.S. Application Data

[63] Continuation of Ser. No. 177,250, Apr. 4, 1988, abandoned, which is a continuation-in-part of Ser. No. 71,247, Jul. 8, 1987, Pat. No. 4,843,051.

[51] Int. Cl.[5] ..... B01J 29/38; B01J 21/20; C10G 11/18; F27B 1/20

[52] U.S. Cl. ..... 502/42; 208/113; 208/164; 422/144; 422/145; 422/147; 502/43; 502/515

[58] Field of Search ..... 502/42, 43; 208/164

[56] References Cited

U.S. PATENT DOCUMENTS

| | | | |
|---|---|---|---|
| 2,382,382 | 8/1945 | Carlsmith | 502/41 |
| 3,785,782 | 1/1974 | Cartmell | 422/144 |
| 3,893,812 | 7/1975 | Conner et al. | 208/164 |
| 3,903,016 | 9/1975 | Owen | 208/120 |
| 3,909,392 | 9/1975 | Horecky, Jr. et al. | 208/120 |
| 3,990,992 | 11/1976 | McKinney | 208/120 |
| 4,051,069 | 9/1977 | Bunn, Jr. et al. | 208/113 |
| 4,056,486 | 11/1977 | Bunn, Jr. et al. | 208/120 |
| 4,118,337 | 10/1978 | Gross et al. | 208/113 |
| 4,219,442 | 8/1980 | Vickers | 208/113 |
| 4,235,704 | 11/1980 | Luckenbach | 208/113 |
| 4,309,309 | 1/1982 | Blanton, Jr. | 208/120 |
| 4,313,848 | 2/1982 | Scott | 208/113 |
| 4,325,833 | 4/1982 | Scott | 208/164 |
| 4,331,533 | 5/1982 | Dean et al. | 208/113 |
| 4,387,043 | 6/1983 | Vickers et al. | 208/164 |
| 4,436,613 | 3/1984 | Sayles et al. | 208/74 |
| 4,666,586 | 5/1987 | Farnsworth | 208/161 |
| 4,828,802 | 5/1989 | Colvert et al. | 502/20 |
| 4,843,051 | 6/1989 | Kovacs et al. | 502/42 |

FOREIGN PATENT DOCUMENTS

| | | | |
|---|---|---|---|
| 806107 | 2/1981 | U.S.S.R. | 502/34 |

OTHER PUBLICATIONS

"Abatement of NOx from Coal Combustion. Chemical Background and Present State of Technical Development", *Ind. Eng. Chem. Process Des. Dev.* 24(1) 1985.

*Primary Examiner*—Paul E. Konopka
*Attorney, Agent, or Firm*—Alexander J. McKillop; Charles J. Speciale; Malcolm D. Keen

[57] ABSTRACT

An FCC catalyst regeneration technique in which the catalyst is regenerated in a dense bed regenerator. Regenerator effluent gases are collected from different parts of the regenerator vessel in a common collection zone and passed through the catalyst separation cyclones from the common collection zone. Removal of nitrogen oxides from the regeneration effluent gases is enhanced by passing spent cracking catalyst through the effluent gases from a secondary spent catalyst inlet in the upper part of the regeneration vessel. Coke on the spent catalyst effects a reduction of nitrogen oxide (NOx) species in the effluent gases to nitrogen.

2 Claims, 3 Drawing Sheets

FLUID CATALYTIC CRACKING REGENERATION

CROSS REFERENCE TO RELATED APPLICATIONS

This is a continuation of copending application Ser. No. 177,250, filed on Apr. 4, 1988, now abandoned, which is a continuation-in-part of prior application Ser. No. 071,247, filed July 8, 1987 in the names of R. C. Kovacs, F. J. Krambeck and M. S. Sarli, entitled "Fluid Catalytic Cracking Regeneration" now U.S. Pat. No. 4,843,051. The disclosure of Ser. No. 071,247 is incorporated in this application.

BACKGROUND OF THE INVENTION

In Ser. No. 071,247 an improved regeneration technique for the fluid catalytic cracking (FCC) process is described. The process described there is capable of improving the operation of the regenerator by promoting combustion of carbon monoxide ahead of the regenerator cyclone inlets so that the "hot cyclone" problem is alleviated. In addition, the NOx emission problems may be reduced. According to application Ser. No. 071,247, the problems associated with operating a conventional, dense bed FCC regenerator in the full CO combustion mode may be alleviated by a modification of the conventional arrangement for the inlets of the regenerator cyclones. By locating the inlets to the cyclones in close proximity to one another or by joining the inlets together with a common inlet manifold or plenum, mixing of the regenerator effluent gases is promoted and, although this does not reduce the total heat release caused by CO combustion, it will reduce the maximum local temperature rise in the region of the cyclones so that increased operating flexibility is obtained. NOx emissions may be reduced by operating the regenerator with a lower amount of excess oxygen and with lower amounts of CO oxidation promoter. Significant reductions in NOx emissions may be obtained by employing an elongated common primary cyclone inlet duct which not only mixes gases from various parts of the regenerator to promote complete combustion of carbon monoxide with residual oxygen from other parts of the bed, but also entrains sufficient catalyst to absorb the heat released by the CO oxidation which occurs, thereby preventing excessive temperature rises in the region of the cyclones.

Reference is made to Ser. No. 071,247 for a full description of the improved regenerator and its method of operation.

SUMMARY OF THE INVENTION

We have now found that the FCC regenerator described in Ser. No. 071,247 may be modified for further potential reductions in $NO_x$ emissions. The regenerator does this by reducing nitrogen oxides (NOx) in the gases produced during the regeneration by the reductive effect of the coke on the spent catalyst from the FCC reactor. The reaction may be represented as:

$$NO_x + C(\text{coke}) = N_2 + CO_x$$

The reduction of the nitrogen oxides in this way is effected by passing at least a portion of the coked, spent catalyst into the upper portion of the regenerator vessel so that it passes through the gases produced by the regeneration before entering the dense bed of catalyst in the lower part of the regenerator vessel where regeneration takes place.

According to the present invention, therefore, there is provided a process for regenerating a fluid catalytic cracking catalyst by contacting the spent catalyst in a dense, fluidized bed regeneration zone where the catalyst is contacted with an oxygen-containing regeneration gas to effect oxidative removal of the coke deposited on the catalyst to produce regeneration effluent gases comprising oxygen, carbon monoxide and carbon dioxide which after contact with spent catalyst entering the regeneration vessel are removed from the regeneration zone through a number of cyclone separators which return catalyst separated from the regeneration effluent gases to the dense bed of catalyst. The cyclone separators receive regeneration gases from different portions of the regenerator vessel in a common collection region, to mix the regeneration gases from the different parts of the vessel so that combustion of carbon monoxide in the regeneration gases takes place before the gases enter the cyclone separators.

The regeneration apparatus according to the present invention comprises a regeneration vessel with at least one inlet for spent catalyst from the FCC reactor, an outlet for regenerated catalyst to return to the FCC cracking zone, a gas inlet for injecting oxygen-containing regeneration gas into a dense fluidized bed of catalyst maintained in the regeneration vessel to regenerate the catalyst and cyclone separators for separating entrained catalyst from the regeneration effluent gases and returning the separated catalyst to the dense bed in the regenerator. The spent catalyst inlet or inlets are arranged so that at least a portion of the spent catalyst entering the regeneration vessel passes through and contacts the gases produced by the regeneration process taking place in the dense bed in the lower part of the vessel. The cyclones have inlets which are disposed to collect regeneration effluent gases from the entire volume of the regenerator (or substantially the entire volume) in a common collection region so that mixing of the regeneration effluent gases from different points in the regeneration vessel takes place prior to the regeneration gases entering the cyclone separators.

The regenerator may be provided with one spent catalyst inlet in the upper part of the regenerator vessel so that all the spent catalyst cascades through the regeneration effluent gases to achieve the maximum degree of contact between the spent catalyst and the regeneration effluent gases. Alternatively, two or more inlets fed by the spent catalyst standpipe from the reactor may be provided with one inlet delivering the spent catalyst in the conventional manner to the dense bed e.g. with a tangential inlet port to impart swirl, and with one or more secondary inlets in the upper part of the regenerator to disperse spent catalyst through the effluent gases to reduce the NOx emissions.

As described in Ser. No. 071,247, the cyclone separators in one version of the apparatus may be located with their inlets located sufficiently close to one another so that they receive the gases from various parts of the regenerator vessel in the region around these adjacent inlets. Alternatively, the cyclone inlets may be joined in a common manifold or plenum so that mixing of the regeneration effluent gases necessarily takes place before the effluent gases enter the cyclones. With this type of arrangement, an elongated cyclone inlet duct may be used to promote entrainment of catalyst from the dilute phase above the dense bed so as to provide a heat sink for the CO oxidation reactions which take place.

THE DRAWINGS

DETAILED DESCRIPTION

The general configuration of the present regenerator and its mode of operation are described in Ser. No. 071,247, to which reference is made for a detailed description. The Figures of the accompanying drawings show FCC regenerator a similar to those shown in FIGS. 4A and 5B of Ser. No. 071,247 but with two spent catalyst inlets at different levels in the regenerator vessel for improved NOx reduction.

Figure 1:
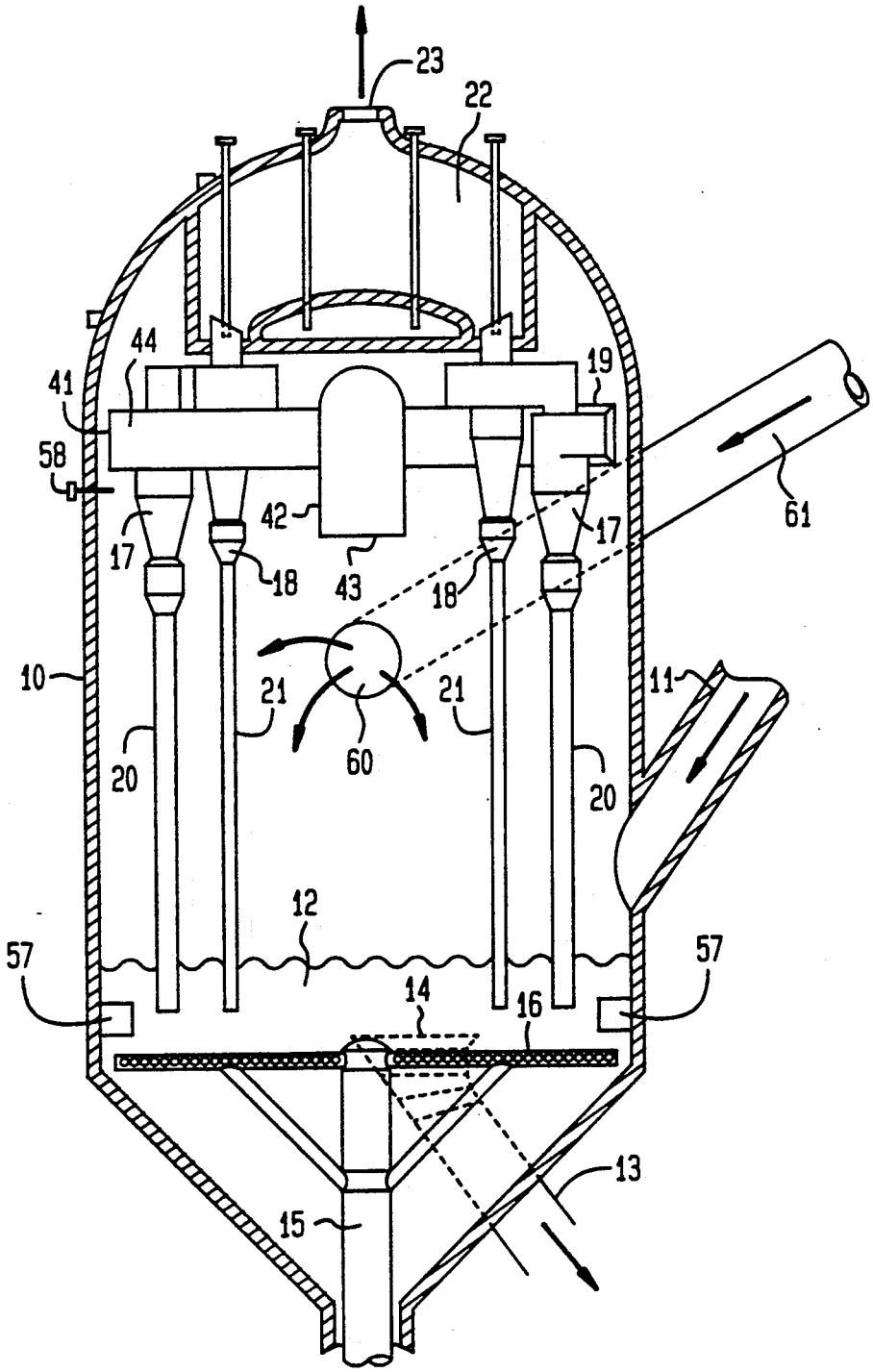
FIG. 1 is a vertical cross-section of an FCC regenerator with the cyclone inlets connected to a common plenum and spent catalyst inlets at two levels in the regenerator vessel.

FIG. 1 shows a high inventory, dense bed regenerator which comprises a regenerator vessel 10 with a tangential spent catalyst inlet which receives spent catalyst from the FCC reactor. The spent, coked catalyst enters regenerator vessel 10 through inlet 11 tangentially and imparts a swirling motion to the dense bed 12 of catalyst in the lower portion of the regenerator vessel. Hot, regenerated catalyst is withdrawn from the regenerator through outlet 13 the top of which is situated below the top of dense bed 12. As mentioned above, outlet orifice 14 is disposed radially around the vertical axis of the regenerator vessel in order to provide a sufficient average residence time for the catalyst particles during the regeneration process so that a sufficient degree of regeneration (coke removal) is achieved. An oxygen-containing regeneration gas, usually air, is injected into the regenerator vessel through air inlet 15 and the injected air is distributed across the regenerator vessel by a distributor grid 16 which is connected to the air inlet 15. Distributor 16 may take various forms including those of a perforated, mushroom-like head, of perforated radial distribution arms or of any other appropriate distribution device which is considered to provide good, even distribution of the air throughout the dense bed of catalyst maintained in the regenerator vessel.

Regeneration of the catalyst takes place in dense bed 12 as the regeneration gas passes through the dense bed to carry out the characteristic regeneration processes including conversion of coke on the spent catalyst to carbon monoxide and carbon dioxide and conversion of carbon monoxide to carbon dioxide. The regeneration effluent gases include excess oxygen, carbon monoxide and carbon dioxide together with nitrogen from the original air, various gases released from contaminants present in the coke deposited on the spent catalyst, especially sulphur oxides ($SO_x$), and gases produced by other reactions in the regenerator, especially nitrogen oxides ($NO_x$). A certain proportion of the catalyst is entrained with the regeneration effluent gases as they rise from the dense bed into the region above it, to form a dilute phase of catalyst particles entrained in the regeneration effluent gases. The effluent gases are vented from the regenerator vessel through primary cyclones 17 and secondary cyclones 18, as described in Ser. No. 071,247, with the inlets of the primary cyclones 17 connected to a common manifold or plenum 41 into which the regeneration effluent gases are channelled from the various parts of the regenerator vessel. The number of cyclones may be adapted to operational and equipment requirements as appropriate.

The common manifold or plenum 41 has a central hub 42 with a downwardly facing inlet port 43 for receiving the regeneration effluent gases from the regenerator vessel. Upon entering the central hub of the manifold the effluent gases are directed along outwardly extending conduits 44 to cyclone inlets 19 so that the effluent gases and entrained catalyst enter the cyclones for separation In this case, also, the regeneration effluent gases will follow a generally helical path of decreasing diameter from the top of the dense bed to inlet port 43 of the cyclone inlet manifold so that mixing of any excess oxygen and any excess carbon monoxide in the effluent gases is promoted with the result that the CO combustion flame front is kept away from the cyclone inlets. Intense mixing occurs in manifold hub 42 to promote combustion of residual carbon monoxide, which may be enhanced by the use of mixing vanes or other arrangements. The arms may be disposed radially or tangentially with respect to the manifold hub and guide vanes for directing the gases into the arms may be provided, if desired. This arrangement has the advantage that existing cyclone disposition may be employed, e.g. existing cyclone hanger bars, although some cyclones may need to be removed in order to provide space for the manifold arrangement, especially the arms extending outwardly from the central hub of the manifold to the cyclone inlets.

The inlet port 43 to the manifold is situated at a relatively high level in the regenerator vessel, so that a significant degree of separation between the entrained catalyst particles and the effluent gases occurs before the effluent gases enter the manifold. This also allows mixing of the gases in the dilute phase prior to entry into the manifold so that pockets of carbon monoxide are more likely to be burned before the effluent gases enter the manifold. If combustion takes place in the manifold itself, the cyclones will still be substantially protected by the use of the manifold but if the degree of catalyst entrainment can be increased, the catalyst particles will act as an additional heat sink for any combustion which may take place and this will not only increase protection for the cyclones, but also will protect the manifold itself from the effects of localized overheating.

In order to provide a reducing species for the reduction of NOx in the regeneration effluent gases, a secondary spent catalyst inlet 60 is provided in the upper part of regenerator vessel 10, with spent catalyst being fed to inlet conduit 61 from the spent catalyst standpipe from the reactor. The coked, spent catalyst from the reactor enters the upper part of the regenerator vessel through inlet 60 and cascades out into the dilute phase of catalyst particles in regeneration effluent gases which exists above dense bed 12. Dispersion of the spent catalyst into the dilute phase may be promoted by distributor plates at the inlet and by providing a number, for example, two or three secondary spent catalyst inlets around the periphery of the upper part of the vessel.

As the spent catalyst cascades into the regeneration effluent gases, reduction of NOx species by the coke component of the spent catalyst takes place as noted above to reduce the emissions of NOx from the regeneration effluent gases.

Figure 2:
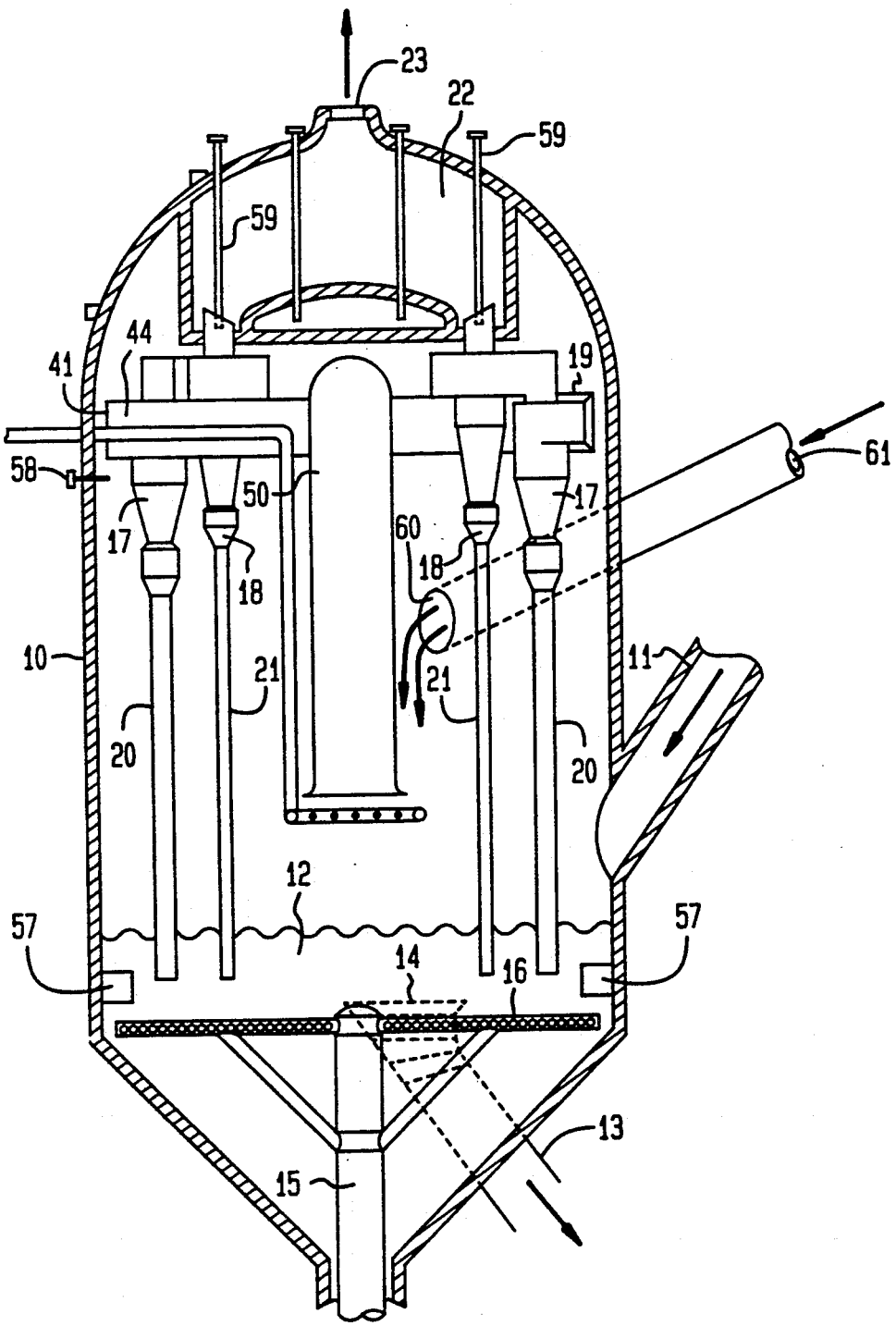
FIG. 2 is a vertical cross-section of an FCC regenerator with the cyclone inlets connected though a manifold to a common inlet duct and spent catalyst inlets at two levels in the regenerator vessel.

As described in Ser. No. 071,247 an elongated inlet duct may be provided to extend down into the dilute phase region of the regenerator vessel, towards the dense bed. A regenerator of this type is shown in FIG. 2. It is generally similar in construction and its mode of operation to the regenerator shown in FIG. 5B of Ser. No. 071,247 although no baffle is fitted below the inlet duct.

The regenerator shown in FIG. 2 has a number of constructional features identical to those shown in FIG. 1 and, accordingly, identical parts have been given identical reference numerals. The regenerator will also operate in the same way as described for the regenerator of FIG. 1 with the differences set out below.

In the regenerator of FIG. 2 the central hub of the cyclone inlet manifold is extended downwardly from the level of the cyclone inlets towards the dense bed of catalyst in the regenerator vessel beneath. The elongated duct 50 is vertical (or substantially so) and is closed at its upper end, forming the top of the manifold hub. The duct is provided with an inlet port 51 at its lower end which faces downwards towards the dense bed of catalyst. The elongated cyclone inlet duct mixes gases from various parts of the regenerator vessel to promote combustion of residual quantities of carbon monoxide with residual oxygen from other parts of the bed. At the same time, the duct extends sufficiently down through the dilute phase that sufficient catalyst is entrained to absorb the heat released by this combustion in the confined gas flow stream passing up the duct, thus preventing excessive temperatures, either in the manifold or in the cyclones themselves. This allows for operation at lower oxygen concentrations for improved efficiency or permits lower levels of CO combustion promoter to be used for reduced $NO_x$ emissions as a consequence of reduced afterburning. Excess oxygen may be reduced to previously unattainable low levels, typically to below 0.5 vol. percent or less, to reduce $NO_x$ emissions by a significant factor.

As in the regenerator shown in FIG. 1, a secondary catalyst inlet 60 fed by inlet conduit 61 from the spent catalyst standpipe from the reactor is provided to reduce NOx emissions by providing a reducing environment in the upper part of the regenerator vessel, as described above. Again, a number of such secondary inlets may be provided around the periphery of the regenerator vessel and distributor plates may be provided to improve dispersion of the catalyst throughout the dilute phase in the upper part of the vessel.

The inlet rate for the combustion air admitted to the air distributor below the dense bed can be adjusted to the stoichiometric air/coke ratio so that reducing conditions are maintained in the dense bed. Under these conditions, formation of nitrogen oxides is disfavored and if any nitrogen oxides are formed, they are reduced to nitrogen or other reduced, gaseous nitrogen species by contact with the spent catalyst in the region above the dense bed. If any air bypassing occurs in the dense bed, secondary combustion of the uncombusted CO which results will take place in the elongated, vertical duct to the cyclone inlet manifold. In this way, staged combustion may be achieved, allowing further reductions in the $NO_x$ level of the effluent gases by maintaining a reducing atmosphere in the dense bed and the dilute phase and completing combustion in the elonged duct. The reducing atmosphere in the dilute phase is enhanced by the coked, spent catalyst entering through the secondary catalyst inlet(s) in the upper part of the vessel.

Control of the oxygen concentrations in the dense bed and the dilute phase may be effected in response to measurements of the oxygen concentration at various points in the regenerator. In FIG. 2, the regenerator employs a temperature sensor 57 in the dense bed and another sensor 58 in the upper part of the vessel. Both sensors may be linked to a flow rate controller for controlling the air inlet rate through inlet 15 and any upper air inlet which may be provided. By maintaining the reducing atmosphere in the dense bed (by suitable control of air inlet rate as indicated by temperature sensor 57) the resulting CO-rich atmosphere in the dense bed and the region immediately above it, enhanced by the reducing effect of the spent catalyst, reduces $NO_x$ species to reduced, gaseous compounds of nitrogen, i.e. $N_2$, $NH_3$ and other gaseous N compounds which are either innocuous or can be readily removed from the regenerator effluent gases by conventional techniques.

Secondary combustion to complete the combustion of the carbon monoxide may be accomplished in the elongated, common inlet duct to the cyclone inlet manifold. The distance from the inlet of the duct to the top of the dense bed is determined to achieve a desired degree of catalyst entrainment so that catalyst enters and passes up the duct or semi-riser and absorbs the heat produced by the combustion of the carbon monoxide in the duct. This will also increase the temperature of the dense bed since the heated catalyst is returned to the den bed by means of the cyclones. This, in turn, promotes good combustion in the dense bed so that low levels of coke on the regenerated catalyst are achieved.

Secondary air for the combustion of the carbon monoxide may be introduced to the dilute phase at a level above the dense bed as described in Ser. No. 071,247, by means of an injection ring 65 disposed around the inlet to the elongated collection duct so that the injected secondary air mixes with the regeneration gases as they enter the duct. Injection ring 65 is connected to air inlet conduit 66 which extends to an air blower (not shown) outside the regenerator.

Figure 3:
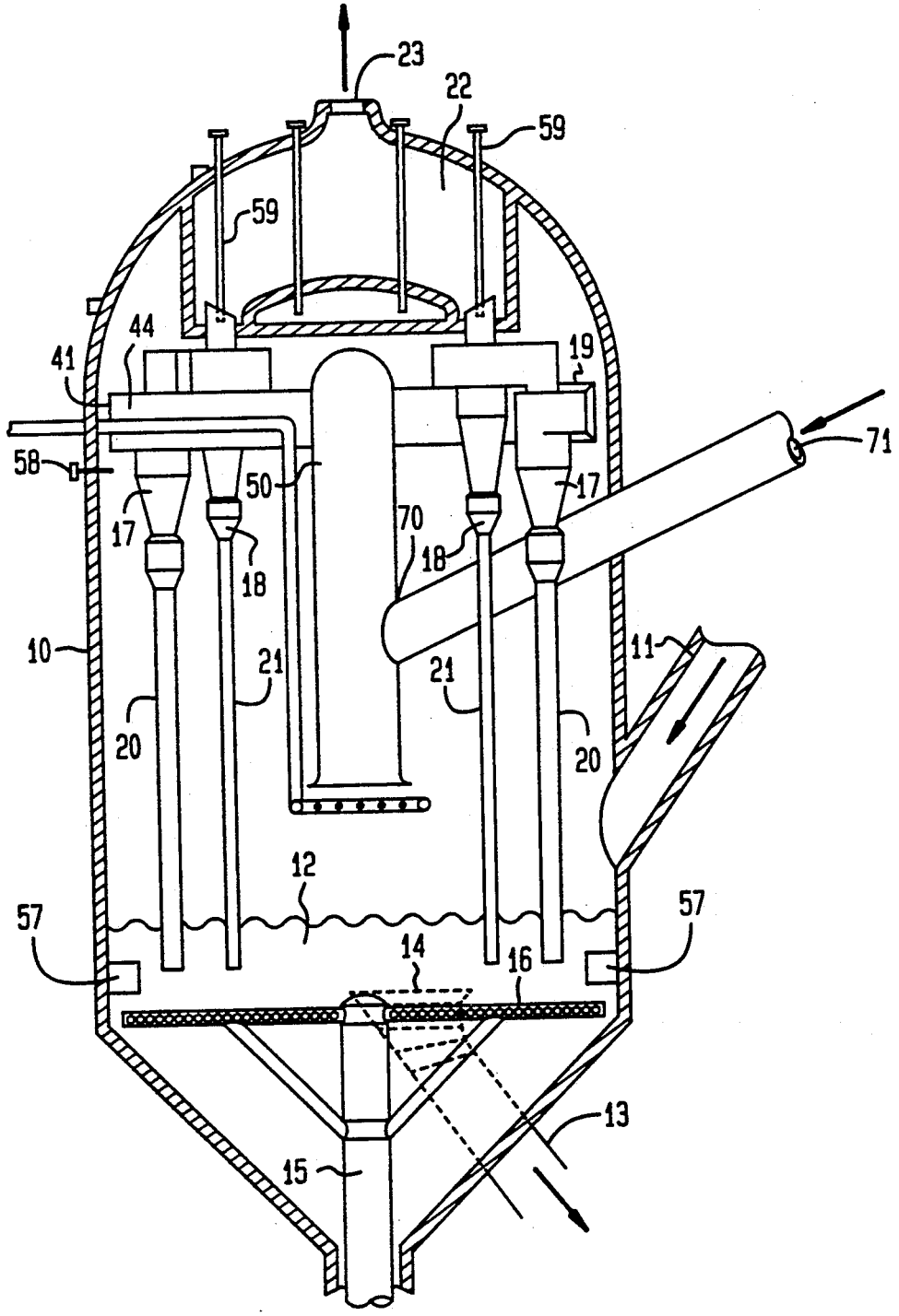
FIG. 3 is a vertical cross-section of an FCC regenerator similar to that of FIG. 2 but with one spent catalyst inlet connected to the common inlet duct.

In the regenerator shown in FIG. 3, the secondary catalyst inlet conduit 71 is connected to the elongated duct 50 at a junction 70 below the manifold for the cyclones. This again ensures that the appropriate reducing atmosphere for the reduction of nitrogen oxide species is maintained by contact of the coked, spent catalyst with the regeneration effluent gases, the contact occurring in this instance in the duct. The regenerator is otherwise identical in construction and operation to that of FIG. 2 and may be fitted with the same ancillary equipment as described above for FIG. 2.

We claim:

1. A method of reducing the emissions of nitrogen oxides from the regeneration of a fluid catalytic cracking catalyst, which comprises:

(i) contacting spend fluid catalytic cracking catalyst from an FCC reactor, the catalyst having coke deposited on it from cracking with an oxygen-containing regeneration gas, in a dense, fluidized bed in a regeneration vessel to effect oxidative removal of the coke deposited on the catalyst, the spent fluid catalytic cracking catalyst being admitted to the regenerator vessel from the FCC reactor through at least two inlets into the regenerator vessel located at different levels in the regenerator vessel, one inlet for the spent catalyst admitting the catalyst into the dense bed and the other into the region above the dense bed.

(ii) maintaining an oxygen/coke ratio in the dense bed to produce regeneration effluent gases containing carbon monoxide by combustion of the coke.

(iii) contacting the spent fluid catalytic cracking catalyst introduced into the regenerator into the region above the dense bed with the regeneration effluent gases in the region above the dense, fluidized bed in the regeneration vessel, (iv) adding additional oxygen-containing regeneration gas in the region above the dense bed, (v) oxidizing carbon monoxide to carbon dioxide in the presence of entrained catalyst particles in the regeneration effluent gases passing upwards through a substantially vertical, elongated duct within the regeneration vessel, the duct having an inlet above the dense bed to receive the carbon monoxide-containing regeneration effluent gases and entrained catalyst particles from the region above the dense bed to form effluent gases containing carbon dioxide and (vi) separating the catalyst particles from the regeneration effluent gas in a plurality of cyclone separators within the regeneration vessel which receive the effluent gases and entrained catalyst particles from said elongated duct and returning the separated particles to the dense bed.

2. A method according to claim 1 in which contact of the spent catalyst with the regeneration effluent gases effects a reduction of nitrogen oxide species in the regeneration effluent gases.

* * * * *